United States Patent [19]

Speedie

[11] 4,386,720

[45] Jun. 7, 1983

[54] ONE-PIECE PLASTIC TAP

[75] Inventor: Robert Speedie, Frankston, Australia

[73] Assignee: Illinois Tool Works Inc., Chicago, Ill.

[21] Appl. No.: 343,622

[22] Filed: Jan. 22, 1982

Related U.S. Application Data

[63] Continuation of Ser. No. 120,601, Feb. 12, 1980, abandoned.

[30] Foreign Application Priority Data

Feb. 19, 1979 [AU] Australia ..... PD7731
Jan. 9, 1980 [AU] Australia ..... PE1946

[51] Int. Cl.[3] ..... B65D 47/20; B65D 43/24

[52] U.S. Cl. ..... 222/498; 215/253; 215/311; 222/541; 251/75

[58] Field of Search ..... 222/213, 215, 498, 501, 222/511, 512, 515, 517, 528–532, 541, 562, 563; 220/213; 215/253, 311, 315; 251/75

[56] References Cited

U.S. PATENT DOCUMENTS

| | | | |
|---|---|---|---|
| 3,400,866 | 9/1968 | Fattori | 222/511 |
| 3,443,728 | 5/1969 | Scholle | 222/511 |
| 3,595,445 | 7/1971 | Buford et al. | 222/511 X |
| 3,642,172 | 2/1972 | Malpas | 222/541 X |
| 3,711,011 | 1/1973 | Kugler | 222/541 X |
| 3,741,447 | 6/1973 | Miles et al. | 222/498 X |
| 3,758,000 | 9/1973 | Mack | 222/562 X |
| 3,883,034 | 5/1975 | Rausing | 222/541 X |
| 3,972,452 | 8/1976 | Welsh | 222/511 X |
| 4,124,151 | 11/1978 | Hazard | 222/498 |
| 4,169,548 | 10/1979 | Bond | 222/511 X |
| 4,211,348 | 7/1980 | Scholle | 222/498 |

*Primary Examiner*—Fred Silverberg
*Attorney, Agent, or Firm*—Jerold M. Forsberg; Thomas W. Buckman

[57] ABSTRACT

The invention relates to a tap for connection to a tube extending from a container for liquids. It includes a barrel having a substantially continuous hollow configuration open at one end and having an outlet opening in its sidewall. The open end of the barrel is adapted for fastening the barrel to the container. There is included a seat surrounding the outlet opening and complimentary plug extending into the interior of the barrel and carried by the closed opposite end of the barrel. At least a portion of the barrel is of a flexible thin-walled diaphragm-like configuration and is adapted to be inverted by a snap action from an open position to a closed position with the plug engaging the seat when in the closed position to shut off the flow of liquid through the tap.

16 Claims, 7 Drawing Figures

ONE-PIECE PLASTIC TAP

This is a continuation, of application Ser. No. 120,601, filed 2/12/80, now abandoned.

This invention relates to improvements in taps and/or valves (hereinafter referred to as "tap") and refers particularly, but not exclusively, to an improved construction of tap for "bag-in-a-box" type of containers such as are provided for wine. Such containers are described in the specification of U.S. Pat. No. 3,642,172, and such taps are in use in Australia under the trade marks "AIRLESFLO" and "SCHOLLE".

An object of the invention is to provide a simplified construction of tap for the dispensing of liquids from a container, which liquids may be relatively viscous—such as detergents or cooking oil—or free-flowing, such as wine.

Another object is to provide a tap which may be made as a one-piece moulding.

A further object is to provide a construction of tap which will operate efficiently in providing for a flow of liquid, which may be controlled as desired, and which will shut off effectively, preferably without any continuing flow-on of the liquid.

Yet another object is to provide a tap for use in the dispensing of wine wherein the passage of oxygen through the tap will be minimized.

It is known that, with the majority of plastics oxygen has the ability to penetrate and pass through thin plastic material. The passage of oxygen through a container for wine has a bearing on the shelf life of the wine. It is desirable that the passage of oxygen through the diaphragm-end of the tap be restricted and to that end there may be provided a membrane across the outlet, with a very thin ring of material around its perimeter, such that when the diaphragm is actuated to move the plug member on its inner side into engagement with the outlet it will engage with that membrane. By a post-moulding welding operation the membrane may be secured to the plug member and when the diaphragm is moved to "open" position it will be pulled away from the outlet, being then part of the diaphragm, to prevent free flow of liquid through the outlet.

According to one aspect of the invention there is provided a tap having a barrel, an outlet opening in the barrel, means at one end of the barrel for attachment of the tap to a container for liquid, wherein part of the barrel constitutes a flexible diaphragm adapted to be moved with a snap action from a closed position to an open position on opposite sides of a dead-center position and from that open position to the closed position, said diaphragm being adapted to engage with and close the outlet opening when in the closed position so as, in use, to shut off the flow of liquid through the tap.

According to another aspect of the invention the tap has a barrel, means at one end of the barrel for securely engaging the outer end of a socket or neck attached to the container for the liquid, an outlet for the liquid at or near the other end of the barrel, and at that other end a diaphragm having a part for engagement with the outlet so as to close it against the flow of liquid and adapted to be moved to an open position to permit flow of liquid. Preferably, the diaphragm has two over-center positions—one when closed and one when fully open—and is adapted to "snap" into position when moved from one position to the other. However, the diaphragm may be made to have only one over-center position, so that it will snap into closed position but requires to be held in the open position.

The tap is designed to be made as a one-piece moulding, and it may be designed to be made in a two-piece die. To permit the diaphragm to be readily actuated a finger-piece is preferably provided on the outer side of the diaphragm, at the outer or front end of the tap, and the diaphragm preferably has on its inner side a plug member at such a location as to engage in and close the inner end of the outlet opening when the diaphragm is moved to the closed position. At the location of that plug member the diaphragm is made of relatively thick material so as to be substantially rigid and capable of making an effective closure. A spout may be provided about the outlet opening to direct liquid downwardly in a compact stream as it flows from the tap, and the upper end of the outlet may be provided with an inwardly directed circumferential lip, to assist in providing a good seating for the closure plug and closure of the outlet.

In order that the invention may be readily understood and conveniently put into practical form one exemplary construction of tap made according to the invention, and a modification thereof, will now be described with reference to the accompanying illustrative drawings, wherein.

Figure 1:
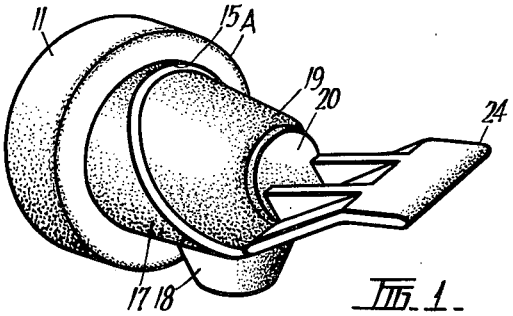
FIG. 1 is a perspective view of the tap.

Referring initially to FIGS. 1, 2, 3 and 4 the tap is indicated generally by the reference A, the inner container by the reference B, the outer container by the reference C, and a neck part attached to the inner container by the reference D. The neck part D is secured to the inner container B, and it has peripheral flanges by which it is engaged with the side wall of the outer container C, in a known manner. The outer end of the neck part D has circumferential ridges and a recess for engagement by complementary formations of the tap when the tap A is fitted to the end of the neck part D.

The tap A has at its rear end a substantially cylindrical socket part 11 having on its inner surface ridges 12 and recesses 13 for engagement with the complementary formations of the neck part D and a spigot 14 for engagement within the front or outer end of the neck part D. Co-axial with the socket part 11 is the barrel 15 of the tap, which has a short cylindrical part 16, curved side walls 17, a downwardly projecting spout 18 on the underside and a diaphragm 19,20. Part 20 of the diaphragm is substantially rigid whereas part 19 is flexible. The spout 18 has an outlet passageway 21 through it and, at its upper end, an inwardly extending flexible circumferential lip 22.

On the inner side of the diaphragm part 20 there is a plug 23 shaped and of a size to engage in and close the upper end of the outlet passageway 21. The diaphragm part 20 and the associated plug 23 are substantially thicker than the diaphragm part 19, which extends from the cylindrical part 16 of the barrel 15 and the curved side walls 17 to the front end part of the tap A so that the diaphragm 19,20 constitutes a complete wall of the tap. The composite diaphragm part 20, plug 23 are relatively rigid. On the outerside of the front part of the diaphragm there is a finger-piece 24 by which the tap may be operated.

Figure 2:
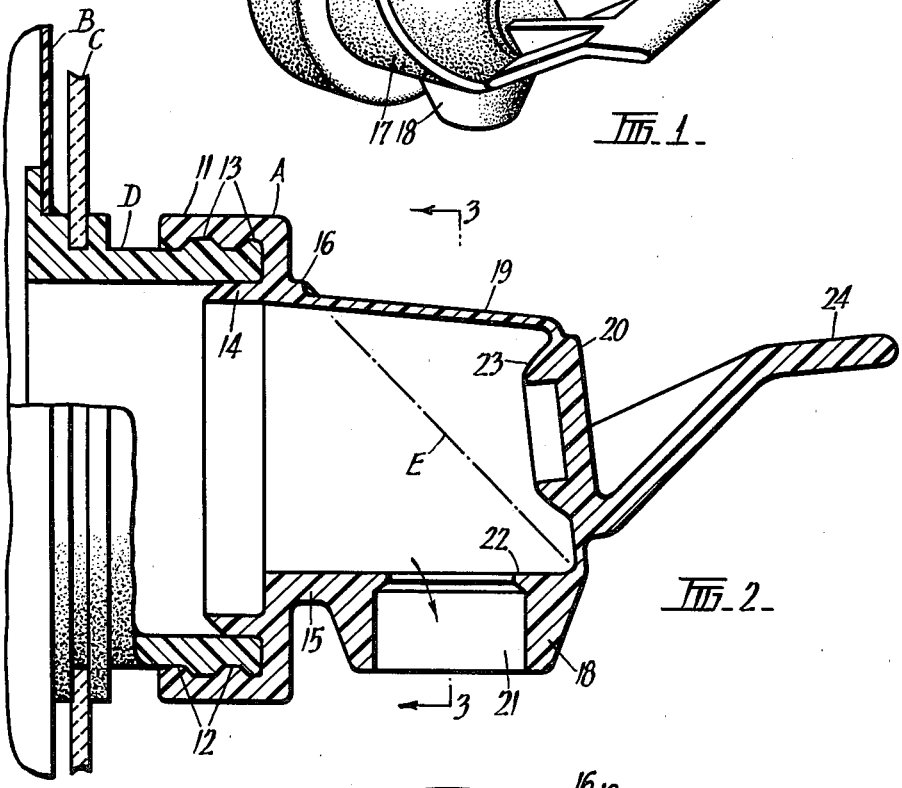
FIG. 2 shows a longitudinal cross-section through the tap depicted in FIG. 1 when attached to a flexible bag-like inner container and a box-like outer container, the tap being in the "open" position.
Figure 3:
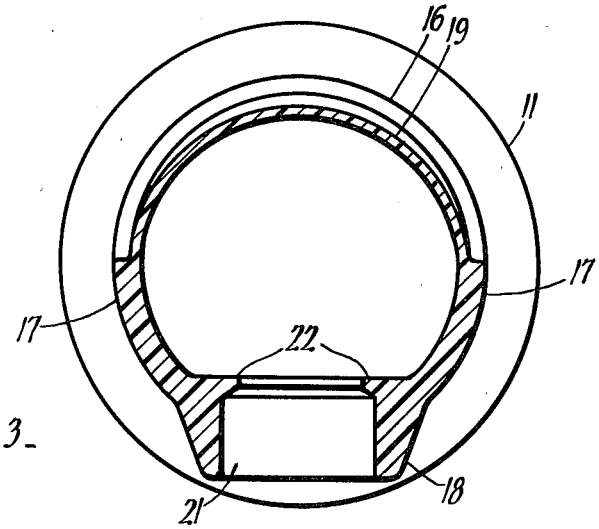
FIG. 3 shows a transverse cross-section through the tap at the location and in the direction indicated by the line and arrows 3—3 of FIG. 2.
Figure 4:
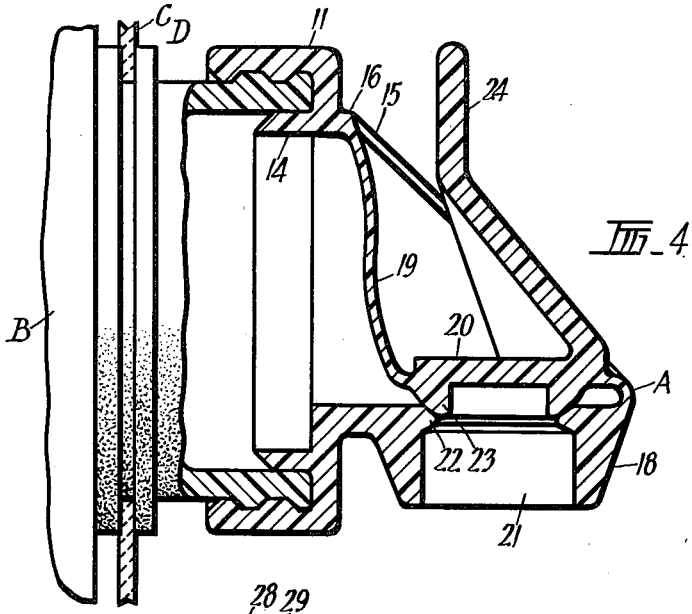
FIG. 4 is a longitudinal cross-section through the tap, similar to FIG. 2, but showing the tap in the "closed" position.

The tap is formed by moulding operations, of a suitable elastomeric thermoplastic material, with the parts thereof in the relative positions as shown in FIGS. 1 and 2, and it is so constructed that upon relative upward movement of the finger-piece 24 such as to cause the part 20,23 to move over the dead-center position indicated by the dotted line E in FIG. 2 the plug 23 will be snapped into engagement with the circumferential lip 22 at the upper end of outlet passageway 21, as shown in FIG. 4. The engagement of the plug 23 with that lip 22 will cause a deflection of the lip which acts, in effect, as a washer to aid in the making of a good seal. When the plug 23 is snapped into that closed position the diaphragm part 19 will be deformed so as to apply a closing pressure to the diaphragm part 20 and plug 23. Note that the length of the diaphragm part 19 from the top of the cylindrical part 16 to the diaphragm part 20 is greater than the direct line between those parts when the plug 23 is engaged within the upper end of the passageway 21, as can be noted in FIG. 4.

When the tap is in the closed position as shown in FIG. 4 and a forward-and-downward pressure is applied to the finger-piece 24 and plug 23 will be disengaged from the upper end of the outlet passageway 21 so as to permit liquid to flow through the tap. If the finger-piece 24 is moved to an extent that the diaphragm part 20 is moved past the dead-center position, as indicated by the line E in FIG. 2, the diaphragm 19,20 will snap to the fully open position shown in FIG. 2.

Figure 5:
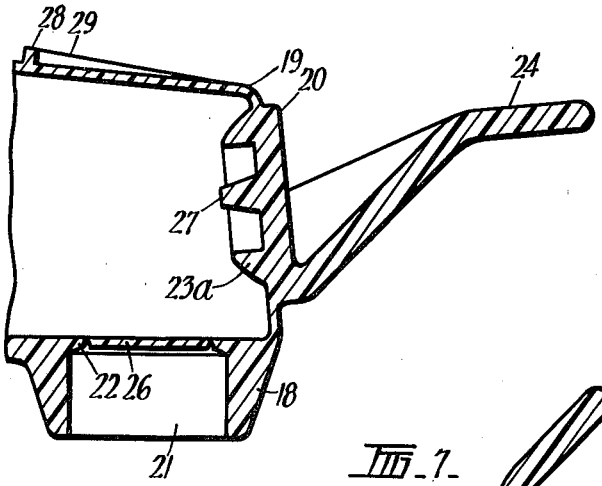
FIGS. 5, 6 and 7 illustrate a modified construction of the front end part of the tap, the views showing the tap in the fully-opened, closed, and partly-opened positions, respectively.
Figure 6:
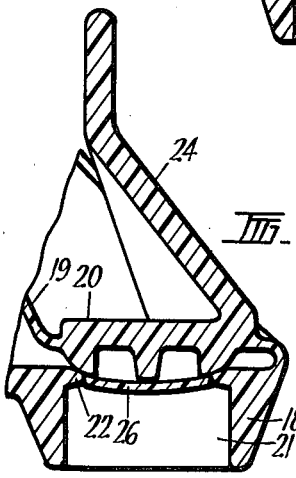
Figure 7:
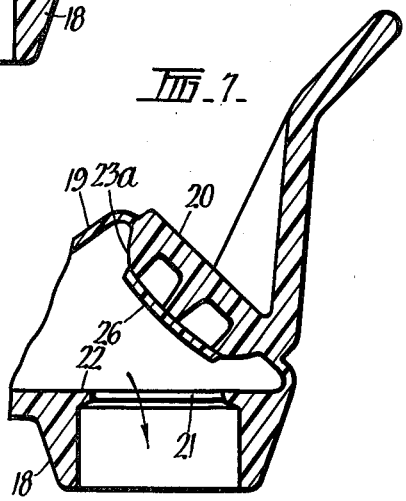

Referring, now, to the modified construction illustrated in FIGS. 5, 6 and 7, a membrane 26 is moulded across the upper end of the outlet passageway 21 with a very thin frangible web between it and the circumferential lip 22. The plug **23*a* has a central post 27 which is of a length to engage firmly with the central part of the membrane 26 when the diaphragm 19, 20 is moved to the closed position, as shown in FIG. 6. Thus, after the moulding operation the diaphragm part 20 and plug 23*a* are moved to the closed position and the membrane 26 is secured to the plug 23*a* by a post-moulding welding operation. Then, when the finger-piece 24 is actuated to open the tap the membrane 26 will be torn away from the lip 22 and thereafter is a part of the plug 23*a*, as shown in FIG. 7**.

It is believed the provision of that membrane 26 will assist in restricting the flow of oxygen through the thermoplastic material from which the inner container B is made and therefore improve the shelf-life of the contents of the inner container B.

If it should be found necessary or desirable to have the diaphragm part 19 more rigid over the top part, that part directly between the top of the cylindrical part 16 and the diaphragm part 20, there may be provided a transverse rib 28 across the top of the diaphragm part 19 and two longitudinal ribs 29, and shown in FIG. 5. It is believed the provision of those ribs 28, 29 will increase the closure pressure applied to the plug 23.

It is apparent that minor modifications in details of design and construction may be made, as by locating the finger-piece or handle on the "upper" part of the diaphragm, without departing from the ambit of the invention. Furthermore, the barrel may be of an external shape other than generally cylindrical, e.g., as rectangular. All such modifications are to be deemed to be included within the ambit of the invention, as defined by the appended claims.

What I claim is:

1. A one piece plastic tap including a substantially continuous hollow barrel open at one end, closed at its opposite end, and having a side wall with a laterally disposed outlet opening, means at the one open end of the barrel for communicating with and attaching said barrel to a container for liquid, plug means extending into the interior of said barrel and carried by the closed opposite end of said barrel, said barrel side wall including a first portion having a substantially rigid wall section that encompasses said attaching means at said one end and said lateral opening and a second portion having a thin-walled flexible diaphragm-like wall section, said flexible second portion adapted to move with a snap action from an initial open position to a closed position and from said closed position to said open position on opposite sides of a dead-center position a seat around said lateral outlet opening engaged by said plug means when said second portion is in the closed position to shut off the flow of liquid through the tap, and integral control means on the exterior of said barrel adjacent said opposite end for initiating movement of said second portion between said open and closed positions.

2. A tap as claimed in claim 1 wherein the means for attaching said tap to a container includes a socket adapted to fit over and engage firmly with a neck part attached to the container for liquid.

3. As tap as claimed in claim 2 wherein said socket includes inner and outer concentric walls for gripping said tubular neck part therebetween, said socket and tubular neck further including cooperating means for restricting axial movement therebetween when assembled.

4. A tap as claimed in claim 3 wherein said cooperating means are screw threads.

5. A tap as claimed in claim 1 wherein said plug means is substantially rigid.

6. A tap as claimed in claim 1 wherein said seat is around the inner end of the outlet opening and has an inwardly extending flexible circumferential lip for engagement by said plug means when said second portion is in the closed position.

7. A tap as claimed in claim 1 wherein there is a spout on the underside of the barrel and the outlet opening is through the spout.

8. A tap as claimed in claim 1 wherein the integral control means includes an outwardly-extending finger-piece.

9. A tap as claimed in claim 1 wherein the tap is a one-piece moulding in a suitable elastomeric thermoplastic material.

10. A tap as claimed in claim 1 wherein the tap as first moulded has a membrane extending across the inner end of the outlet opening with a frangible connection between the periphery of the membrane and the material at the inner end of the outlet opening.

11. A tap as claimed in claim 10 wherein said barrel, including said plug means, are moulded in an open position, said plug means being then moved towards the closed position and fastened to said membrane, said membrane sealing said outlet opening until the plug is then moved to its open position thereby fracturing the frangible connection to thereby remove said sealing membrane from said outlet and permit flow of liquid therethrough.

12. A tap as claimed in claim 11 wherein said plug means is fastened to said membrane by heat sealing.

13. A tap as claimed in claim 1 wherein said barrel is generally a horizontally disposed slightly tapered cylinder with said outlet being disposed along a chord on the undersurface thereof, the juncture of said rigid first portion and flexible second portion lying on a plane that is angularly disposed relative to and passes through the axis of said barrel.

14. A tap as claimed in claim 13 wherein said opposite end carrying said plug means is generally perpendicular to said axis of said barrel when said second portion is in its open position and generally parallel to said axis when said second portion is in its closed position.

15. A tap as claimed in claim 13 wherein said rigid first portion and said flexible second portion present a continuous smooth inner wall surface with the difference in wall thickness at the juncture being present on the exterior wall surface thereby providing a smooth surface to the flow of liquid and precluding a residue buildup.

16. A tap as claimed in claim 1 wherein said second flexible portion is provided with external reinforcing rib means to assist in operation of said tap between said open and closed positions.

* * * * *